US008918962B2

(12) United States Patent
Schrader

(10) Patent No.: US 8,918,962 B2
(45) Date of Patent: Dec. 30, 2014

(54) DECORATIVE DOOR HANDLE

(71) Applicant: Robert J. Schrader, Belleville, IL (US)

(72) Inventor: Robert J. Schrader, Belleville, IL (US)

( * ) Notice: Subject to any disclaimer, the term of this patent is extended or adjusted under 35 U.S.C. 154(b) by 1 day.

(21) Appl. No.: 13/998,274

(22) Filed: Oct. 17, 2013

(65) Prior Publication Data

US 2014/0115829 A1 May 1, 2014

Related U.S. Application Data

(60) Provisional application No. 61/719,785, filed on Oct. 29, 2012.

(51) Int. Cl.

| | |
|---|---|
| ***A45C 3/00*** | (2006.01) |
| ***E05B 1/00*** | (2006.01) |
| *E05B 15/16* | (2006.01) |

(52) U.S. Cl.

CPC ..... *E05B 1/0015* (2013.01); *E05B 15/1607* (2013.01); *E05B 15/1635* (2013.01)

USPC ..... 16/412

(58) Field of Classification Search

USPC ..... 16/110.1, 111.1, 412

See application file for complete search history.

(56) References Cited

U.S. PATENT DOCUMENTS

| | | | | |
|---|---|---|---|---|
| 2,731,663 | A * | 1/1956 | Thompson | 16/422 |
| 4,134,480 | A * | 1/1979 | Davis | 16/405 |
| 5,675,867 | A * | 10/1997 | Howie, Jr. | 16/412 |
| 6,895,635 | B2 * | 5/2005 | Tisol et al. | 16/110.1 |
| 6,954,967 | B2 * | 10/2005 | Park et al. | 16/412 |
| 2003/0182762 | A1 * | 10/2003 | Koops et al. | 16/412 |
| 2008/0086843 | A1 * | 4/2008 | Lee et al. | 16/412 |
| 2009/0151503 | A1 * | 6/2009 | Stafford, Jr. | 74/525 |
| 2010/0205780 | A1 * | 8/2010 | Ieda et al. | 16/412 |

* cited by examiner

*Primary Examiner* — Victor Batson
*Assistant Examiner* — Matthew Sullivan
(74) *Attorney, Agent, or Firm* — Paul M. Denk

(57) ABSTRACT

A decorative door handle comprising a flexible material configured in the shape of a door handle and a malleable stiffener material to maintain the handle in a desired useful looking configuration. In one aspect the flexible material is a magnetic vinyl.

6 Claims, 2 Drawing Sheets

DECORATIVE DOOR HANDLE

CROSS REFERENCE TO RELATED APPLICATION

This non-provisional patent application claims priority to the provisional patent application having Ser. No. 61/719,785, filed on Oct. 29, 2012.

FIELD OF THE INVENTION

This invention involves the formation of door handles that may be used upon garage doors, or the like, and function as decorative means, which have three dimensional visuals, that make the applied door handle appear to be an actual and authentic utility handle, when installed.

BACKGROUND OF THE INVENTION

The invention relates generally to decorative door handles and, more particularly, to a decorative door handle that has a more realistic appearance than those currently known in the art.

Many houses have doors that face the street, such as garage doors or insulated storm doors. Most of these doors are metal clad and plain in appearance. To dress up the door and make them more aesthetically pleasing, the homeowner may apply decorative hinges and handles of a contrasting color. For example, the homeowner may include decorative black hinges or handles on a white door. If the homeowner installs the decorative hinges or handle with attachment means, such as screws that require drilling into the metal door, the integrity of the door is wined. Moisture can enter through the screw holds. Moreover, drilling holes into the metal door can void the warranty.

Magnetic decorative hinges and handles are known. However, in the case of the handles, the known expedients generally lay flat against the door and lack depth. The handles do not look functional or real and hence are not aesthetically pleasing. It would be advantageous to have a decorative handle that can be formed to have a real or functional appearance.

SUMMARY OF THE INVENTION

In one aspect, a decorative magnetic handle formed from a flexible sheet of magnetic material. The magnetic material can be cut or otherwise formed in any desired configuration or design to have the appearance of a door handle. In one aspect there is a malleable stiffener applied to at least a section of the magnetic vinyl material. Usually the vinyl sheet is doped with magnetic particles. The stiffener can be bent or otherwise manipulated to form a raised gripping area. The magnetic handle is placed on the surface of the metal door. The snug magnetic bond between the handle and the door effectively holds the handle in place. The raised gripping area gives the handle the appearance of a real, functional handle and adds to the aesthetically pleasing look of the handle, if not the entire door.

In another aspect, the handle can be constructed from a flexible material and have a stiffening component but is attached to the door by use of attachment means such as glue, epoxy, tape and so forth.

DESCRIPTION OF THE PREFERRED EMBODIMENT

Figure 1:
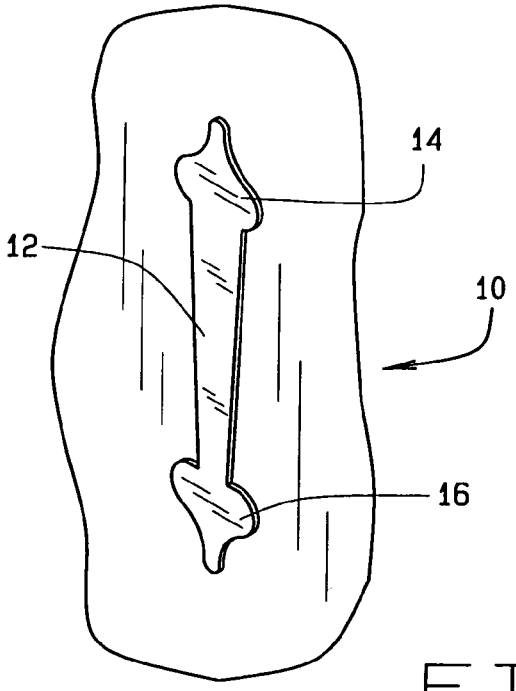
FIG. 1 PRIOR ART
FIG. 1 is a perspective view of a prior art decorative magnetic handle of a flat configuration on a metal clad garage door.

FIG. 1 shows a prior art decorative magnetic handle, indicated by number 10, positioned on the outer surface of a metal clad garage door D. It will be noted that handle 10 is orientated such that its longitudinal axis is vertical. Handle 10 generally has a central gripping portion 12 and a first decorative element 14 at the top and a second decorative element 16 at the bottom end. In the illustrated prior art, the decorative elements are spade shaped. As seen, handle 10 is flat against the surface of door D and lacks depth and realism.

Figure 2:
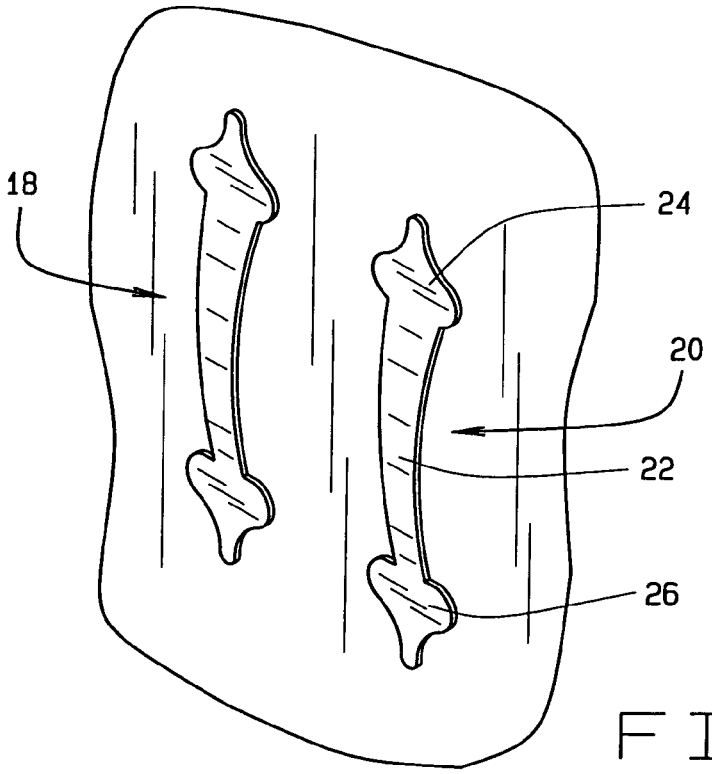
FIG. 2 is a perspective view of a pair of decorative handles of the present invention on a metal clad garage door.

FIG. 2 shows a pair of decorative handles of the present invention, indicated by numbers 18 and 20. The two handles are identical in configuration, having an apparent gripping section 22, and first spade shaped decorative end element 24 at the top and a second spade shaped decorative end element 26 at the bottom of the gripping section. It will be understood that the handle configuration are illustrative of one aesthetically pleasing configuration and that any configuration of decorative end elements may be employed.

As noted, the gripping sections 22 are raised curves or arches. This arched configuration keeps the gripping section raised or elevated from the plane of the door and gives the handle a realistic, utilitarian look. The raised gripping section gives the appearance that a user could grasp the handle in a functional manner. It will be understood that the arched or curved configuration or the gripping section is but one choice. The gripping area could have sharp bends and appear essentially rectangular or to any other configuration, as desired.

Figure 3:
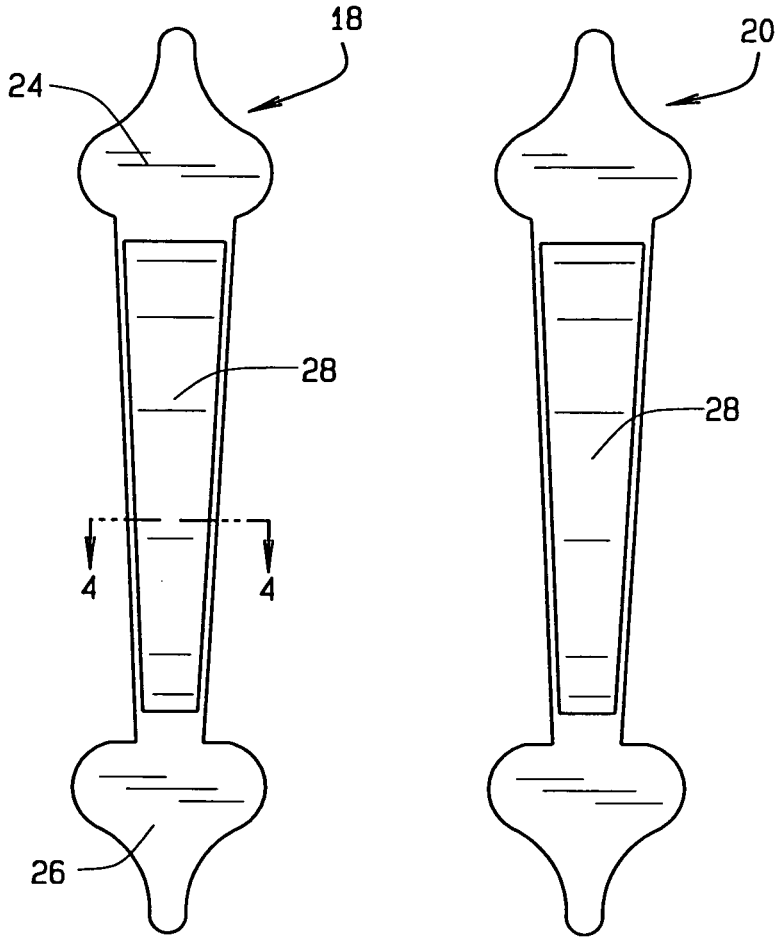
FIG. 3 shows the back sides of a plurality of the decorative handles.

In one aspect, decorative handles 18 and 20 comprises a flexible magnetic material such as 20 mil super hold magnetic doped vinyl sheeting. Any thickness that functions properly may be used. The sheeting can be die cut to, or otherwise cut or stamped into the desired configuration of a handle. The magnetic vinyl holds the handle in a desired orientation upon the door by a strong magnetic bond. FIG. 3 illustrates one embodiment of a back side of handles 18 and 20. It will be noted that there is a stiffener layer 28 on the back side of the gripping section. In one aspect, stiffener layer 28 comprises a malleable material, such as light gauge aluminum. However, the stiffener layer could comprise any functional material such as metal, plastic, polystyrene, aluminum tape and so forth. Moreover, the malleable material could be incorporated inside the decorative handle and not applied as a separate external element or layer, as will be later described. In any event, the malleable material, or stiffener, allows the gripping area to retain its useful, raised configuration when the handle is bent to the desired shape.

Figure 4:
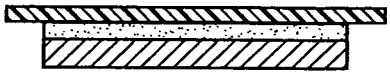
FIG. 4 provides a cross sectional view showing how the malleable stiffener may be applied by an adhesive or a double faced tape to the interior surface of the decorative handle.

FIG. 4 shows a cross section of one of the embodiments of the decorative door handle. As noted, it includes its gripping section 22, and having its malleable stiffening portion or layer 28, held into position upon the inner surface of the section 22 by means of an adhesive, double faced tape, or the like, as noted at 30. In addition, where the stiffening layer 28 may be made of flexible steel, which can be bent to an arcuate or other design shaped shape, it may be held in position upon the inner surface of the gripping section 22 by means of the magnetic attraction from the magnetic vinyl forming said handle.

Figure 5:
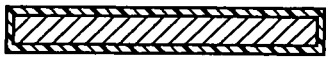
FIG. 5 shows how the malleable stiffener may be embedded within the polymer material as it is molded to form the decorative handle.

As an alternative, FIG. 5 shows how the stiffening layer 28 may be molded integrally within the gripping section 31 of the formed decorative handle. These are examples of variations of the method of construction of the malleable handle, having sufficient flexibility that it may be bent into particular shapes, such as arcuate, rectangular, or the like, before it is applied to the door as a decorative handle.

Although the handles of the present invention have been described, in one aspect, as magnetic, the handles could be fashioned from a nonmagnetic material, such as conventional vinyl, and affixed to the garage door surface with tape, glue, epoxy or other means.

Also, although the decorative handles are shown attached to garage doors, they can be attached to any door, such as a front door, a storm door or the like. The handle can be painted as desired.

It will be appreciated that the handle of the present invention can be formed in any desired size or configuration. Moreover, it can be used on any door to improve the look of the door.

I claim:

1. A decorative door handle for application to a garage door, comprising: a flexible material configuration in the shape of an elongated door handle and a malleable stiffener material to maintain the handle in a desired useful three dimensional configuration, said malleable stiffener material is a thin layer of malleable metal applied on a backside of said handle, to maintain said handle in a shaped configuration, said flexible material forming the handle having a pair of securing elements proximate said handle ends that are capable of securing to the surface of a door, said malleable stiffener material being located intermediate said handle securing elements proximate the backside of said handle to provide for that shaped configuration to said handle during application, said layer of secured metal capable of reshaping by hand to shape the configuration of the door handle to a selective shape and appearance, said flexible material forming the shaped handle comprise magnetic doped vinyl, wherein the flat securing elements can be affixed magnetically to the surface of the door, and wherein the arcuate configured stiffener material and the flexible material configuration can be shaped into its arcuate configuration furnish a partially raised portion of the decorative door handle during usage.

2. The decorative door handle of claim 1 wherein the malleable stiffener is applied to the inner surface of the arcuate portion of the door handle.

3. The decorative door handle of claim 1 wherein the malleable stiffener material is applied by adhesive to the inner surface of the arcuate portion of the decorative door handle.

4. The decorative door handle of claim 1 wherein the malleable stiffener material is applied by double adhesive tape to the inner surface of the arcuate portion of the decorative door handle.

5. The decorative door handle of claim 1 wherein the flexible material configuration for the door handle is molded form a polymer, and the malleable stiffener material is molded within the polymer when it is molded into the shape of the decorative door handle, and the malleable stiffener material may be reshaped by hand into the desired arched configuration for the door handle during application and usage.

6. The decorative door element of claim 1, wherein the malleable stiffener is adhered by magnetic attraction to the inner surface of the door handle.

* * * * *